United States Patent [19]

Saeva

[11] 3,961,948

[45] June 8, 1976

[54] PHOTOCHROMIC IMAGING METHOD

[75] Inventor: Franklin D. Saeva, Webster, N.Y.

[73] Assignee: Xerox Corporation, Stamford, Conn.

[22] Filed: Aug. 2, 1974

[21] Appl. No.: 494,246

Related U.S. Application Data

[63] Continuation of Ser. No. 323,589, Jan. 15, 1974.

[52] U.S. Cl. ..... 96/1 R; 96/1.1; 96/1 PC; 96/1.5; 96/27 R; 96/48 R; 96/48 HD; 96/90 PC

[51] Int. Cl.[2] ..... G03C 13/00; B41M 5/18; G03C 5/24; G03G 16/00

[58] Field of Search ..... 96/1.1, 1 R, 27 R, 48 HD, 96/48 R, 1 PC, 1.5, 90 PC

[56] References Cited

UNITED STATES PATENTS

| | | | |
|---|---|---|---|
| 3,441,410 | 4/1969 | Brynko | 96/1.5 |
| 3,445,225 | 5/1969 | Brynko et al. | 96/1.1 |
| 3,450,531 | 6/1969 | Amidon et al. | 96/27 R |
| 3,451,811 | 6/1969 | Brynko | 96/1 R |

OTHER PUBLICATIONS

Golden; J. Chem. Soc. pp. 3741–3748 (1961).

*Primary Examiner*—Won H. Louie, Jr.
*Attorney, Agent, or Firm*—James J. Ralabate; James Paul O'Sullivan; John H. Faro

[57] ABSTRACT

An imaging method based upon visible light induced changes in a photochromic imaging layer containing a dispersion of at least one of the following compounds:

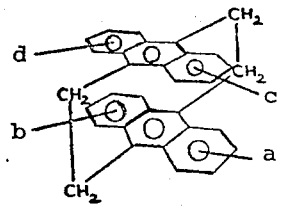

where *a*, *b*, *c* and *d* are independently selected from the group consisting of hydrogen, halogen, $NO_2$, $NH_2$, lower alkyl, phenyl, phenoxy, lower alkoxy, carboxy, hydroxyl, lower alkyl esters and aryl esters, in an organic film forming binder.

35 Claims, No Drawings

PHOTOCHROMIC IMAGING METHOD

This is a continuation, of application Ser. No. 323,589, filed Jan. 15, 1974.

1. Field of the Invention

This invention relates to an imaging method utilizing photochromic materials. More specifically, this invention concerns an imaging method wherein image formation and development are based upon visible light induced changes in a photochromic imaging layer.

2. Description of the Prior Art

Imaging techniques employing photochromic materials, that is materials which undergo reversible or irreversible photoinduced color changes are well known in the art. The irradiation of these materials with light of the appropriate wave length is believed to result in formation of a new chemical species possessing different chemical, electrical and/or physical properties from the original ground state thermodynamically stable photoisomer. The extent to which such changes occur may not produce discernible changes in the illuminated material; however, the absence of drastic or highly visible changes in color, for example, is not necessary if such illumination is sufficient to cause a relative shift in some of the other physical, chemical or electrical property of the photochromic compound so as to provide a differential or gradient within the material which can thus serve as the basis for subsequent image development.

Most of the photochromic materials heretofore available have been difficult to prepare and require high energy activation to raise them to an energy plateau sufficient to produce the desired photochromic reaction. The energy requirements of these materials have, therefore, traditionally demanded irradiation with ultraviolet light. This type of high energy activation often produces undesirable consequences. For example, where a photochromic material is to be used in a cyclic imaging system, this type of repeated high energy irradiation of the photochromic imaging layer can result in degradation of the photochromic compound. Such degradation can produce yet another compound or mixture of compounds which can introduce unexpected and unpredictable changes in the response of the photochromic imaging layer. These photochromic compounds have been typically dispersed in organic polymeric resins in formation of the imaging layer. Even where the photochromic compounds used in such imaging layers are resistant to degradation upon repeated exposure to irradiation with ultra violet light, many of these resins are not, and will undergo discoloration and/or adverse changes in their mechanical properties.

Another factor which is often critical in the successful use of photochromic materials in an imaging system is the ability of such materials to undergo rapid and complete reversal of the photochromic reaction. This quality is determinative of the efficiency of such materials in a cyclic imaging system. The ease and completeness of such reversal will vary widely depending upon the particular photochromic compounds. At one extreme, the photochromic reaction is irreversible or the reversal cannot be readily controlled. If the reaction is irreversible, such compounds, cannot, therefore, be used in a cyclic imaging system. When photochromic reversal cannot be controlled, the situation is analogous to degradation. For example, in the thermal reversal of a photochromic reaction, the compound may pass from the higher energy state to the lower energy state, or proceed further resulting in the formation of still yet other compounds which are not photochromic.

Consequently, there is an unfulfilled need for a photochromic imaging system which is capable of repeated cyclic use and yet free from the problems of degradation and incomplete reversal commonly associated with photochromic imaging layers.

It is, therefore, an object of this invention to provide a photochromic imaging method free from the above noted deficiencies in the prior art.

Another of the objects of this invention is to provide an imaging system based upon the photoinduced charges in chemical, electrical and physical properties occurring upon selective illumination of a photochromic imaging layer.

A further object of this invention is to provide a photochromic imaging system in which the reusable photochromic imaging layer is activated by visible light.

A still further object of this invention is to provide a photochromic imaging system capable of repeated and rapid reversal of the photochromic reaction without degradation of the imaging layer.

SUMMARY OF THE INVENTION

The above and related objects are attained by providing an imaging method based upon visible light induced differences in the relative physical properties, chemical properties, and/or electrical properties of a photochromic compound and its corresponding photoisomer. The photochromic imaging layer employed in the above method comprises a dispersion of at least about 1 weight percent of at least one cyclic photochromic compound of the formula:

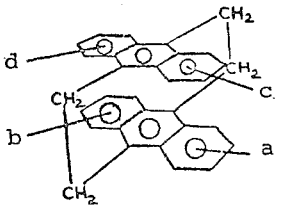

where *a*, *b*, *c* and *d* are independently selected from the group consisting of hydrogen, halogen, $NO_2$, $NH_2$, lower alkyl, phenyl phenoxy, lower alkoxy, carboxy, hydroxyl, lower alkyl ester and aryl ester in an organic film forming polymeric resin. The properties of these resins must be compatible with the mode of image generation and development contemplated by the particular imaging system and be compatible with the photochromic compound and its corresponding photoisomer. For example, where the photochromic imaging method is based upon differences in spectral absorption, the resinous matrix containing the photochromic compound(s) should be transparent and preferably colorless. Such polymeric resins must also be compatible with thermal reversal of the photochromic reaction. In the preferred embodiments of this invention, the photochromic compounds are cyclo bis(anthracene-9,10-dimethylene); cyclo bis (anthracene-1-bromo-9,10-dimethylene); cyclo bis(anthracene-1-chloro-9,10-dimethylene) cyclo bis (anthracene-1-amino-9,10-dimethylene); cyclo bis(anthracene-1-nitro-9,10-dimethylene); and cyclo bis(anthracene-1-methyl-9,10-dimethylene).

DESCRIPTION OF THE INVENTION INCLUDING PREFERRED EMBODIMENTS

Imaging Layer — The composition and surface characteristics of the imaging layer determines to a great extent the mode of generation and development of the photochromic image.

Under some circumstances, the photochromic imaging layer can be composed solely of photochromic compounds provided that the compound selected has the requisite strength and film-forming ability and further provided that it possesses the requisite physical characteristics demanded during generation and development of the photochromic image. In most photochromic imaging systems, however, it is both more practical and economical to disperse the photochromic compounds in a film-forming resinous binder. Since these compounds are highly efficient in their absorption of actinic radiation, only relatively small concentrations (as low as about 1 weight percent) are necessary to produce or induce the requisite changes in properties in the illuminated areas of the imaging layer to provide the basis for image formation and development.

The photochromic compounds described previously can be readily prepared from commercially available starting materials by techniques disclosed in the literature, see for example, Golden, J. Chem. Soc. 3741 (1961). These compounds are relatively inexpensive to prepare, highly sensitive to light in the visible spectrum and rapidly returned to their low energy state subsequent to illumination by exposure to somewhat elevated temperatures.

The physical, chemical and electrical nature of the resinous binder selected for use in a particular imaging layer will vary with the mode of generation and development of the photochromic image. For example, where the image is formed by color differences between the irradiated and non-irradiated areas of the imaging layer, the spectral properties of the binder will be of uppermost importance; whereas, in case of the formation of a deformation or "Frost" image, the photodischarge characteristics and temperature required to soften the photochromic imaging layer are critical.

It is, therefore, impractical to attempt to define with any degree of precision all the properties of the resinous materials useful in forming the photochromic image layer for the varied imaging methods of this invention, other than to indicate that such materials must be compatible with the photochromic compounds dispersed therein, and capable of forming films of the requisite mechanical strength and surface characteristics required of the specific imaging technique utilizing this imaging layer.

Representative of polymeric resinous binders which can be used in the photochromic imaging methods of this invention include the insulating resins disclosed in U.S. Pat. No. 3,450,531; the insulating thermoplastic resins disclosed in U.S. Pat. No. 3,450,530; the aromatic organic photoconductive resins disclosed in U.S. Pat. No. 3,445,225; and the polar and non-polar resins disclosed in U.S. Pat. No. 3,450,533; all the above patents being hereby specifically incorporated by reference. The polymeric resinous binders disclosed in U.S. Pat. Nos. 3,441,411; 3,443,646; 3,411,410; and 3,422,759 can also be used for dispersion of the photochromic compounds in preparation of the imaging members employed in the methods of this invention; these patents also being incorporated by way of reference into the instant disclosure.

The specific configuration of the photochromic imaging layer used in one or more of the contemplated imaging methods may also require association of a film of one or more of the above photochromic compounds with a specific type of substrate. This substrate can be a conductive material such as copper, brass, aluminum, silver, gold, or optically transparent layers of tin oxide or copper iodide on glass. In imaging methods requiring the association of the photochromic compounds with such a substrate, the dispersal of such compounds in a polymeric resinous binder is generally recommended both from the viewpoint of ease of preparation and physical durability of such an imaging layer.

It is preferable, that when such compounds are dispersed in a resinous binder, that the resulting dispersion form a film which is sufficiently coherent and of mechanical strength to be self supporting.

In preparation of such films, the resin and photochromic compound(s) are either dispersed in a common solvent or the resin heated until molten and the compound dispersed therein. The photochromic imaging layer may then be formed by casting the resulting melt or dispersion into the shape desired or by coating another surface with said melt or dispersion by any of a variety of well known coating techniques. For most practical imaging methods, the thickness of such photochromic layer will generally not exceed 50 microns. Layer thickness is determined by the type of properties demanded of such layer in a particular imaging system. For example, where the resin is present in a concentration of about 1 weight percent, the minimum layer thickness for a photochromic imaging layer useful in an imaging method based upon difference in spectral absorption is approximately 5 microns. In the event that maintenance of an electric field across the photochromic layer is essential to imaging mode, the thickness and insulating qualities of such layer are usually critical.

Irrespective of the specific type of imaging system, the photochromic imaging layer is selectively irradiated during the imaging sequence with visible light and the photochromic compounds within these light struck areas of the layer converted to their corresponding photoisomers. Differences in properties between the non-irradiated compounds and their photoisomers provides the basis for all the various imaging systems contemplated within the scope of this invention.

Representative of some of the property differences which can be used in both visible or latent image formation are: spectral absorption, molar refraction, dipole moment, molar volume, solubility crystal form, adsorption, contact angle, surface energy, melting point, viscosity, conductivity, chemical reactivity, photoconductivity, and triboelectric properties.

Where image formation and development does not permanently transform or alter the surface of the imaging layer, said imaging layer can be reused in formation and development of subsequent images. Ordinarily, this involves merely restoration of the physical characteristics of said surface and the thermal reversal of the photochromic transition. The temperature required to restore the imaging layer to its former nonilluminated state will vary with the extent of conversion of the photochromic compounds in the imaging layer. For example, where the imaging system is based upon photoinduced differences in spectral absorption, the degree of exposure required to generate such color differences is normally extensive and thus, reversal will require more intensive exposure to thermal energy. In some systems, such as in deformation imaging, such thermal treatment will both accelerate reversal of the photochromic reaction and restore the frosted surface of the imaging layer to its former specular condition. The photochromic compound(s) used in these imaging layers need not in all instances require thermal reversal. However, in the absence of such thermal input, the erasure of the visible or latent imaging pattern within the photochromic imaging layer is often very slow and may be incomplete. Generally, such reversal is carried out at temperatures of from about 20° to 150°C without decomposition of the photochromic compound or occasioning any adverse changes in the polymeric dispersal medium. Temperatures in the range of from about 50° to 80°C provide relatively complete and rapid erasure of the photochromic image without thermal degradation of most of the polymeric binders which can be used in dispersion of these compounds.

The Examples which follow further define, describe and illustrate preparation and use of the photochromic imaging members employed in the various methods of this invention. The techniques and equipment set forth in preparation and use of these imaging members are presumed to be standard or as hereinbefore described. Parts and percentages appearing in these Examples are by weight unless otherwise stipulated.

EXAMPLE I

The imaging method described in U.S. Pat. No. 3,411,410 is repeated except for the substitution of an imaging member prepared as follows:

A mixture of 0.020 parts of cyclo bis(anthracene-9,10-dimethylene) and 2.0 parts polyhexadecyl acrylate (Tg ~ 35°C) are dissolved in 10 milliliters of tetrahydrofuran. One milliliter of the solution is cast on an aluminum plate 2 inches square by 0.005 inches thick and the solvent allowed to evaporate thus forming a uniform, coherent and adherent film on said plate having an average thickness of about 8 microns. This film is cured, a quartz glass transparency placed over and in contact therewith, and the film exposed by a 90 watt Xenon lamp from a distance of 1 centimeter for a period of 5 minutes. After exposure, the film is corona charged to a positive potential of approximately 250 volts, and then heated by means of a hot air gun slightly above its glass transition temperature for an interval of about 10 seconds. As the film softens, the light struck areas take on a frosted appearance, thus forming a visible image. This image is then recorded by monitoring the reflectance of a given wavelength of light from this frosted imaging layer.

Since this imaging layer is to be reused in formation of subsequent images, the frosted pattern is thermally erased by heating this imaging layer to a temperature of about 40°C thus maintaining the frosted imaging layer in a low viscosity state for a sufficient period to allow for discharge of the surface charge on the frosted layer by fluid migration of ions and the restoration of the specular surface of the layer by the surface tension of the polymeric binder.

EXAMPLE II

The procedures of Example I are repeated except that the deformable image pattern is not erased but rather preserved by cooling the imaging layer subsequent to development.

EXAMPLE III

A photochromic imaging layer is prepared and imaged as described in Example I. After removal of the quartz glass target from the imaging layer, this layer is corona charged to a positive potential of approximately 300 volts and sprayed with negatively charged colored powder. Since the illuminated areas of this imaging layer are less conductive than those masked by the transparency, their retention of the surface charge is greater and thus, the negatively charged colored powder is selectively attracted thereto rendering visible the latent electrostatic image.

EXAMPLE IV

An imaging member prepared as disclosed in Example I is employed in the imaging method disclosed in U.S. Pat. No. 3,450,531; the following providing a brief description of said method.

The photochromic imaging layer of the above member is imaged through a quartz glass transparency with a 90 watt Xenon lamp from a distance of one centimeter for an interval of three minutes. After exposure, the imaged film is heated to a point just above its glass transition temperature (~ 35°C), thus rendering the film adhesive in imagewise configuration. Immediately thereafter, this imaging layer is contacted with a "donor" member, the surface of which having a uniform coating of loosely adhering carbon black particles. Upon separation of the donor member and the imaging member, carbon black particles are found to adhere to the imaging layer, forming a negative image on the imaging member and a positive image on the surface of the donor member. The intensity and resolution of the resulting images are evaluated visually and deemed of acceptable quality.

EXAMPLE V

An imaging member prepared as described in Example I is employed in the imaging method described in U.S. Pat. No. 3,450,530; the following providing a brief description of said method.

The photochromic imaging layer of the above member is uniformly charged to a positive potential of about 500 volts, heated to just above its glass transition temperature (~ 35°C) whereby a uniform fine grain frosted pattern is formed over substantially all of the surface of the imaging layer. The imaaging layer is subsequently cooled thus fixing the frosted pattern on its surface. This frosted imaging member is then imaged through a quartz glass transparency with a 90 watt Xenon lamp from a distance of one centimeter for an interval of four minutes. After exposure, the imaged film is exposed to xylene vapor by repeatedly passing a blotter saturated with this solvent over the frosted surface of the film whereupon selected frosted areas (unexposed background) of the film revert to their former smooth condition thus forming a frosted image pattern on the surface of the film. The intensity and resolution of the image are evaluated visually and rated to be of acceptable quality.

EXAMPLE VI

An imaging member prepared as described in Example I is employed in the imaging method disclosed in U.S. Pat. No. 3,450,533; the following providing a brief description of said method.

The photochromic imaging layer of the above member is imaged through a quartz glass transparency with a 90 watt Xenon lamp from a distance of about one centimeter for an interval of 3 minutes, and thereafter exposed to xylene vapors whereupon crystallization of the polymeric resin is affected in the exposed areas of the imaging member. The development of this light scattering image pattern is believed attributable to the relative differences in polarity of the materials in the imaged and nonimaged areas and the affinity of the nonpolar solvent on these less polar regions (unexposed) of the imaged layer. Image intensity and resolution are evaluated visually and regarded as yielding reproductions of good quality.

EXAMPLE VII

An imaging member prepared as described in Example I is employed in the imaging method disclosed in U.S. Pat. No. 3,445,225; the following providing a brief description of said method.

The photochromic imaging layer of the above member is uniformly illuminated with a 90 watt Xenon lamp from a distance of one centimeter for an interval of about 200 seconds, charged to a positive potential of about 700 volts and a light and shadow image projected onto the charged imaging layer thus forming a latent electrostatic image thereon by selective dissipation of charge in the light-struck areas. This latent electrostatic image is thereafter rendered visible by contacting said imaging layer with toner particles of an opposite polarity. The toner image is then transferred and fused to a sheet of untreated paper. The intensity and resolution of the image thus produced is of a commercially acceptable quality.

EXAMPLES VIII — X

The imaging systems described in Examples I–VII are repeated except for the substitution of an imaging member having a photochromic layer of the following composition.

| Example No. | Photochromic Compound and Concentration | Polymeric Resin and Concentration |
|---|---|---|
| VIII | 0.05 parts of cyclo bis(anthracene-9,10-dimethylene) | 2.00 parts poly (propylmethacrylate) Tg~35°C |
| IX | 0.10 parts of cyclo bis(anthracene-9,10-dimethylene) | 2.00 parts poly (4-ethyl) styrene-Tg~27°C |
| X | 0.25 parts of cyclo bis(anthracene-9,10-dimethylene) | 2.00 parts poly (vinylacetate) Tg~27°C |

What is claimed is:

1. An imaging method based upon the visible light induced differences with respect to the relative physical properties, chemical properties or electrical properties of a photochromic compound and its corresponding photoisomer, said method comprising:

a. providing a photochromic imaging member wherein the imaging layer comprises a dispersion of at least 1 weight percent of at least 1 cyclic photochromic compound of the formula:

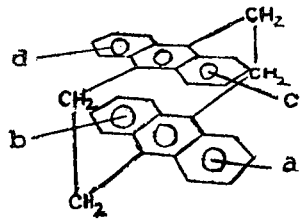

wherein *a*, *b*, *c* and *d* are independently selected from the group consisting of hydrogen, halogen, $NO_2$, $NH_2$, lower alkyl, phenyl, phenoxy, lower alkoxy, carboxy, hydroxyl, lower alkyl esters and aryl esters in a film-forming polymeric resin;

b. forming a latent image within said imaging layer by imagewise exposure of said imaging layer to sufficient visible light to convert the photochromic compound(s) to its (their) corresponding photoisomer(s); and c. rendering said latent image visible by charging the surface of the imaging layer followed by the heating of said layer to or slightly above the glass transition temperature of the polymeric resin, whereby the exposed areas of the imaging layer take on a frosted appearance.

2. The imaging method of claim 1, wherein the photochromic compound is cyclo bis)anthracene-9, 10-dimethylene).

3. The imaging method of claim 1, wherein the photochromic compound is cyclo bis(anthracene-11 -chloro-9,10-dimethylene).

4. The imaging method of claim 1, wherein the photochromic compound is cyclo bis(anthracene-1-amino-9,10-dimethylene).

5. The imaging method of claim 1, wherein the photochromic compound is cyclo bis(anthracene-1-nitro-9,10-dimethylene).

6. The imaging method of claim 1, wherein the photochromic compound is cycle bis(anthracene-1-methyl-9,10-dimethylene).

7. The imaging method of claim 1, wherein the imaging layer contains a 1:1 weight ratio of the cyclo bis(anthracene-9,10-dimethylene) to film forming polymeric resin.

8. An imaging method based upon the visible light induced differences with respect to the relative physical properties, chemical properties or electrical properties of a photochromic compound and its corresponding photoisomer, said method comprising:

a. providing a photochromic imaging member wherein the imaging layer comprises a dispersion of at least 1 weight percent of at least 1 cyclic photochromic compound of the formula:

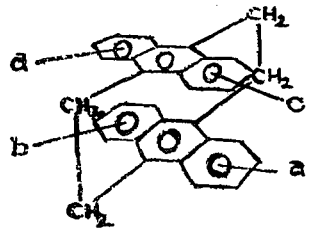

wherein *a*, *b*, *c* and *d* are independently selected from the group consisting of hydrogen, halogen, $NO_2$, $NH_2$, lower alkyl, phenyl, phenoxy, lower alkoxy, carboxy, hydroxyl, lower alkyl esters and aryl esters in a film-forming polymeric resin;

b. forming a latent image within said imaging layer by imagewise exposure of said imaging layer to sufficient visible light to convert the photochromic compound(s) to its (their) corresponding photoisomer(s); and c. rendering said latent image visible by charging the surface of the imaging layer followed by contacting said charged surface with a charged colored powder, the relative polarity of the surface charge and the charge on the colored powder causing the attraction of said powder to those areas of the imaging layer capable of retention of the surface charge.

9. The imaging method of claim 8, wherein the photochromic compound is cyclo bis(anthracene-9,10-dimethylene).

10. The imaging method of claim 8, wherein the photochromic compound is cyclo bis(anthracene-1-chloro-9, 10-dimethylene).

11. The imaging method of claim 8, wherein the photochromic compound is cyclo bis(anthracene-1-amino-9,10-dimethylene).

12. The imaging method of claim 8, wherein the photochromic compound is cyclo bis(anthracene-1-nitro-9,10-dimethylene).

13. The imaging method of claim 8, wherein the photochromic compound is cyclo bis(anthracene-1-methyl-9,10-dimethylene).

14. The imaging method of claim 8, wherein the imaging layer contains a 1:1 weight ratio of the cyclo bis(anthracene-9,10-dimethylene) to film-forming polymeric resin.

15. An imaging method based upon the visible light induced differences with respect to the relative physical properties, chemical properties or electrical properties of a photochromic compound and its corresponding photoisomer, said method comprising:

a. providing a photochromic imaging member wherein the imaging layer comprises a dispersion of at least 1 weight percent of at least 1 cyclic photochromic compound of the formula:

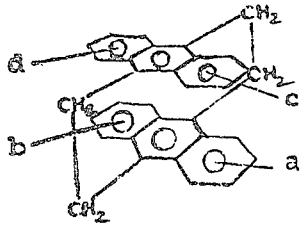

wherein *a*, *b*, *c* and *d* are independently selected from the group consisting of hydrogen, halogen, $NO_2$, $NH_2$, lower alkyl, phenyl, phenoxy, lower alkoxy, carboxy, hydroxyl, lower alkyl esters and aryl esters in a film-forming polymeric resin;

b. forming a latent image within said imaging layer by imagewise exposure of said imaging layer to sufficient visible light to convert the photochromic compound(s) to its (their) corresponding photoisomer(s); and c. rendering said latent image visible by (*i*) heating of the surface of the imaging layer to a point just above its glass transition temperature thereby rendering the surface of the imaging layer adhesive in imagewise configuration, (ii) contacting said adhesive image with the surface of a donor member, said surface being coated with loosely adhering colored particles, and (*iii*) separating said donor member and said imaging layer, whereby colored particles are transferred to the adhesive areas of said imaging layer from the surface of said donor member.

16. The imaging method of claim 15, wherein the photochromic compound is cyclo bis(anthracene-9,10-dimethylene).

17. The imaging method of claim 15, wherein the photochromic compound is cyclo bis(anthracene-1-chloro-9,10-dimethylene).

18. The imaging method of claim 15, wherein the photochromic compound is cyclo bis(anthracene-1-amino-9, 10-dimethylene).

19. The imaging method of claim 15, wherein the photochromic compound is cyclo bis(anthracene-1-nitro-9, 10-dimethylene).

20. The imaging method of claim 15, wherein the photochromic compound is cyclo bis(anthracene-1-methyl-9, 10-dimethylene).

21. The imaging method of claim 15, wherein the imaging layer contains a 1:1 weight ratio of the cyclo bis(anthracene-9,10-dimethylene) to film-forming polymeric resin.

22. An imaging method based upon the visible light induced differences with respect to the relative physical properties, chemical properties or electrical properties of a photochromic compound and its corresponding photoisomer, said method comprising:

a. providing a photochromic imaging member wherein the imaging layer comprises a dispersion of at least 1 weight percent of at least 1 cyclic photochromic compound of the formula:

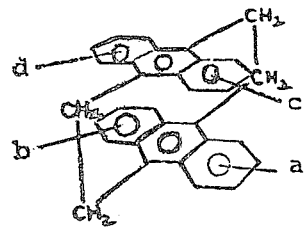

wherein *a*, *b*, *c* and *d* are independently selected from the group consisting of hydrogen, halogen, $NO_2$, $NH_2$, lower alkyl, phenyl, phenoxy, lower alkoxy, carboxy, hydroxyl, lower alkyl esters and aryl esters in a film-forming polymeric resin;

b. uniformly frosting the imaging layer;

c. forming a latent image within said imaging layer by imagewise exposure of said imaging layer to sufficient visible corresponding photoisomer(s); and d. rendering said latent image visible by exposing the frosted surface of the imaging layer to solvent vapors whereby the unexposed surface of the film reverts to its former smooth condition.

23. The imaging method of claim 22, wherein the photochromic compound is cyclo bis(anthracene-9,10-dimethylene).

24. The imaging method of claim 22, wherein the photochromic compound is cyclo bis(anthracene-1-chloro-9, 10-dimethylene).

25. The imaging method of claim 22, wherein the photochromic compound is cyclo bis(anthracene-1-amino-9, 10-dimethylene).

26. The imaging method of claim 22, wherein the photochromic compound is cyclo bis(anthracene-1-nitro-9, 10-dimethylene).

27. The imaging method of claim 22, wherein the photochromic compound is cyclo bis(anthracene-1-methyl-9. 10-dimethylene).

28. The imaging method of claim 22, wherein the imaging layer contains a 1:1 weight ratio of the cyclo bis(anthracene-9,10-dimethylene) to film-forming polymeric resin.

29. An imaging method based upon the visible light induced differences with respect to the relative physical properties, chemical; properties or electrical properties of a photochromic compound and its corresponding photoisomer, said method comprising:

a. providing a photochromic imaging member wherein the imaging layer comprises a dispersion of at least 1 weight percent of at least 1 cyclic photochromic compound of the formula:

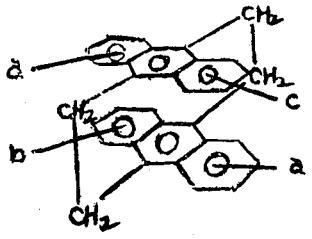

wherein *a*, *b*, *c* and *d* are independently selected from the group consisting of hydrogen, halogen, $NO_2$, $NH_2$, lower alkyl, phenyl, phenoxy, lower alkoxy, carboxy, hydroxyl, lower alkyl esters and aryl esters in a film-forming polymeric resin;

b. forming a latent image within said imaging layer by imagewise exposure of said imaging layer to sufficient visible light to convert the photochromic compound(s) to its (their) corresponding photoisomer(s); and c. rendering said latent image visible by exposing the surface of the imaging layer to solvent vapors whereby the polymeric resin of said imaging layer is crystallized in the exposed areas of the imaging layer.

30. The imaging method of claim 29, wherein the photochromic compound is cyclo bis(anthracene-9,10-dimethylene), 31. The imaging method of claim 29, wherein the photochromic compound is cyclo bis(anthracene-1-chloro-9, 10-dimethylene).

32. The imaging method of claim 29, wherein the photochromic compound is cyclo bis(anthracene-1-amino-9, 10-dimethylene).

33. The imaging method of claim 29, wherein the photochromic compound is cyclo bis(anthracene-1-nitro-9, 10-dimethylene).

34. The imaging method of claim 29, wherein the photochromic compound is cyclo bis(anthracene-1-methyl-9, 10-dimethylene).

35. The imaging method of claim 29, wherein the imaging layer contains a 1:1 weight ratio of the cyclo bis(anthracene-9,10-dimethylene) to film-forming polymeric resin.

* * * * *